United States Patent [19]

Cheak

[11] 4,254,895

[45] Mar. 10, 1981

[54] APPARATUS FOR AUTOMATIC ALIGNMENT AND ATTACHMENT OF A DOORJAMB AND STOP

[75] Inventor: Edward G. Cheak, Chico, Calif.

[73] Assignee: Norfield Manufacturing Co., Chico, Calif.

[21] Appl. No.: 43,859

[22] Filed: May 30, 1979

[51] Int. Cl.[3] ..... B27F 7/02

[52] U.S. Cl. ..... 227/50; 227/100; 227/152

[58] Field of Search ..... 227/39, 40, 48, 50, 227/99, 100, 103, 104, 140, 150, 152, 153

[56] References Cited

U.S. PATENT DOCUMENTS

| | | | |
|---|---|---|---|
| 3,763,547 | 10/1973 | Blakeslee | 227/48 X |
| 4,039,112 | 8/1977 | Schultz | 227/48 X |

*Primary Examiner*—Paul A. Bell

*Attorney, Agent, or Firm*—Townsend and Townsend

[57] ABSTRACT

Automatic apparatus for attaching together individual doorstops and doorjambs in relative registered, longitudinal alignment includes hoppers for containing vertical stacks of the stops and jambs, a transport mechanism that reciprocally withdraws individual ones of the stops and jambs from the vertical stacks and transports the withdrawn stop and jamb to a work station, a registering device for positioning the distal ends of the jamb and stop in relative, adjacent registration, clamp apparatus located at the work station that receives, clamps and longitudinally aligns the stop to the jamb, and a number of linearly aligned air nailers overlying and, in effect, defining the work station for dispensing nails used to attach the stop to the jamb while held by the clamp apparatus.

14 Claims, 24 Drawing Figures

APPARATUS FOR AUTOMATIC ALIGNMENT AND ATTACHMENT OF A DOORJAMB AND STOP

This invention relates to apparatus that automatically and reciprocally feeds individual doorstop/doorjamb combinations to a work station when they are attached to one another in relative, registered, longitudinal relation with greater speed and accuracy then previously attainable.

BACKGROUND OF THE INVENTION

The advantages obtained by adopting methods of fabricating pre-hung doors have been known and utilized by the building industry for some time. For example, U.S. Pat. Nos. 3,263,723 and 4,100,611 describe machines for preparing doors for hanging and for fabricating pre-hung doors.

So far as is known, however, such automatic fabrication techniques have not heretofore been extended to the construction of certain parts of the frame that forms the door opening—specifically, the attachment of the doorstop to the doorjamb. It is required that the stop and jamb be in relative longitudinal alignment when attached to one another to provide the appropriate relief between leading edges of the two pieces to allow the door to close properly. Further, the ends of the two pieces must often be placed in adjacent registration. Such alignment, registration and attachment of stops to jambs have been performed manually.

Further, the stops and/or jambs that are used sometimes are warped a small amount, which warpage must be taken into account to ensure proper indexing between the leading edge of the stop and jamb to which it is attached. To perform these tasks manually requires time and expense. Thus, to provide automatic apparatus capable of performing the task of individually aligning and affixing doorstops to doorjambs with relatively precise accuracy can result in a great savings of both time and money.

SUMMARY OF THE INVENTION

The present invention provides apparatus that automatically performs the necessary relative registration, alignment and attachment of doorstops to doorjambs in reciprocal fashion. The objective of attaching doorstops to doorjambs in accurate relative, registered relation by automatic techniques has thereby been achieved.

Thus, according to the present invention, there is provided automatic doorstop-jamb attachment apparatus that includes hoppers for containing the stops and corresponding jambs to be attached to one another, a transport mechanism that withdraws one stop and one jamb from the hoppers and transports them to a work (attachment) station for attachment to one another, a clamp mechanism, situated at the work station, that clamps the stop and jamb in relative longitudinally aligned, end-registered relation and positions the stop and jamb in operable relation to attachment apparatus to effect attachment of the two pieces together.

In the preferred embodiment, the stops and jambs are contained in and held by a pair of hoppers in adjacent, parallel, vertical stacks. The transport mechanism includes a number of parallel, elongate transport bars that extend transverse the vertical stacks of stops and jambs. The transport bars move longitudinally between a first position underlying the hoppers and their contents and a second position proximate the work station. The bars are provided with stop-receiving notches for receiving a doorstop from the bottom of the stack of doorstops and a spring-loaded dog which functions to withdraw a jamb from the bottom of its respective stack. Movement of the bars will withdraw one stop and one jamb from the bottom of each stack and position the withdrawn pieces in general registered relation with the jamb overlying the stop. The transport bars move to the second position, urging the withdrawn pieces toward the work station defined by a linear arrangement of twelve air-actuated nailers that overlie the clamping apparatus.

The transport bars deposit the withdrawn pieces at the work station where they can be received by clamping apparatus which clamps the pieces in longitudinally aligned relation, positions the aligned pieces in operable relation with the air nailers, and supports the pieces during attachment of one to the other via a simultaneous nailing operation.

Additionally, there is provided apparatus that registers the respective ends of the withdrawn pieces as they are transported to the work station for attachment.

For a better understanding of the present invention, together with other and further features thereof, reference is had to the following description taken in conjunction with the accompanying drawings, the scope of the invention being pointed out in the claims.

DETAILED DESCRIPTION OF THE PREFERRED EMBODIMENT

Figure 1:
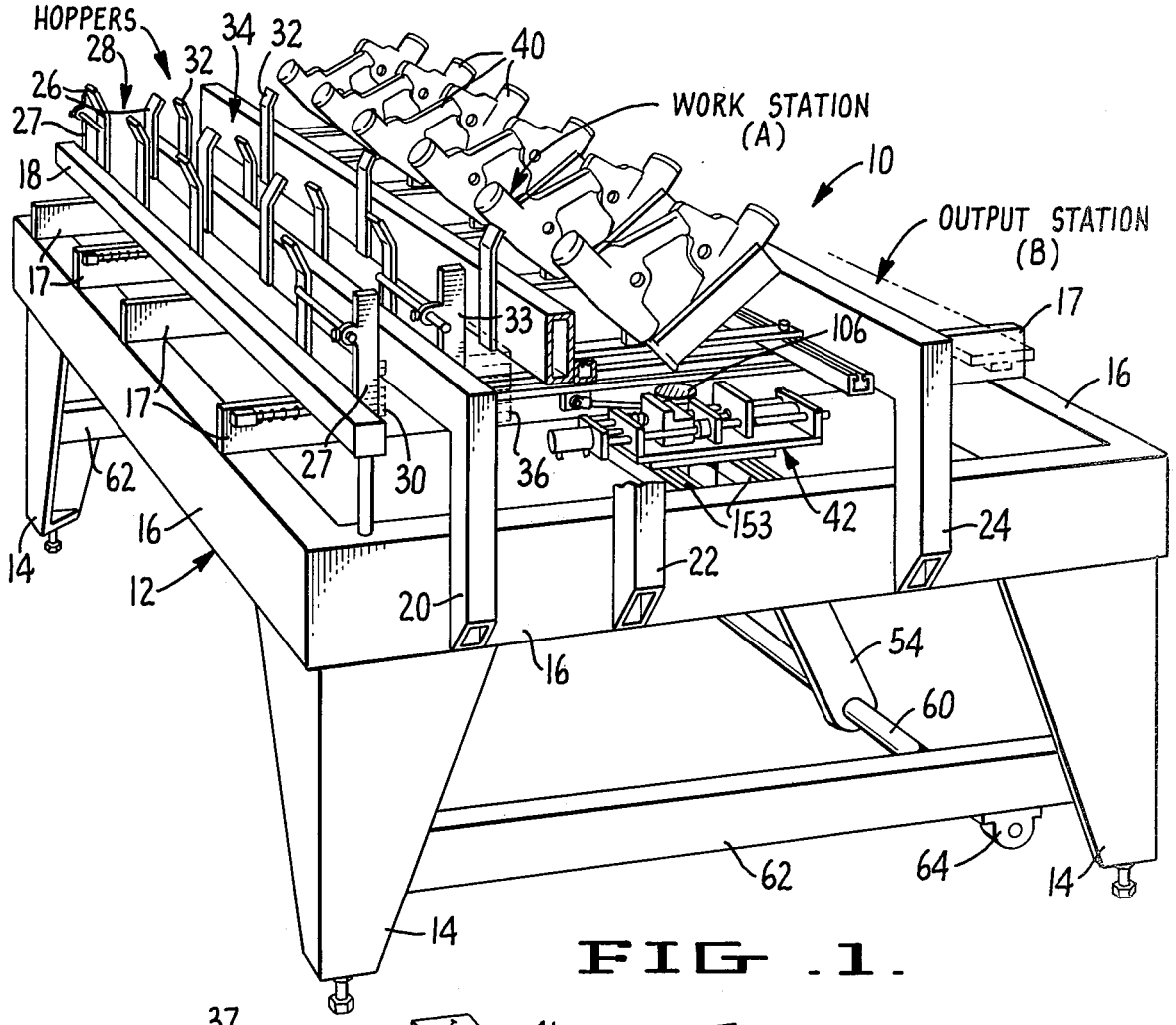
FIG. 1 is a perspective view of the apparatus embodying the present invention, including hoppers containing stacks of individual doorjambs and doorstops.
Figure 4:
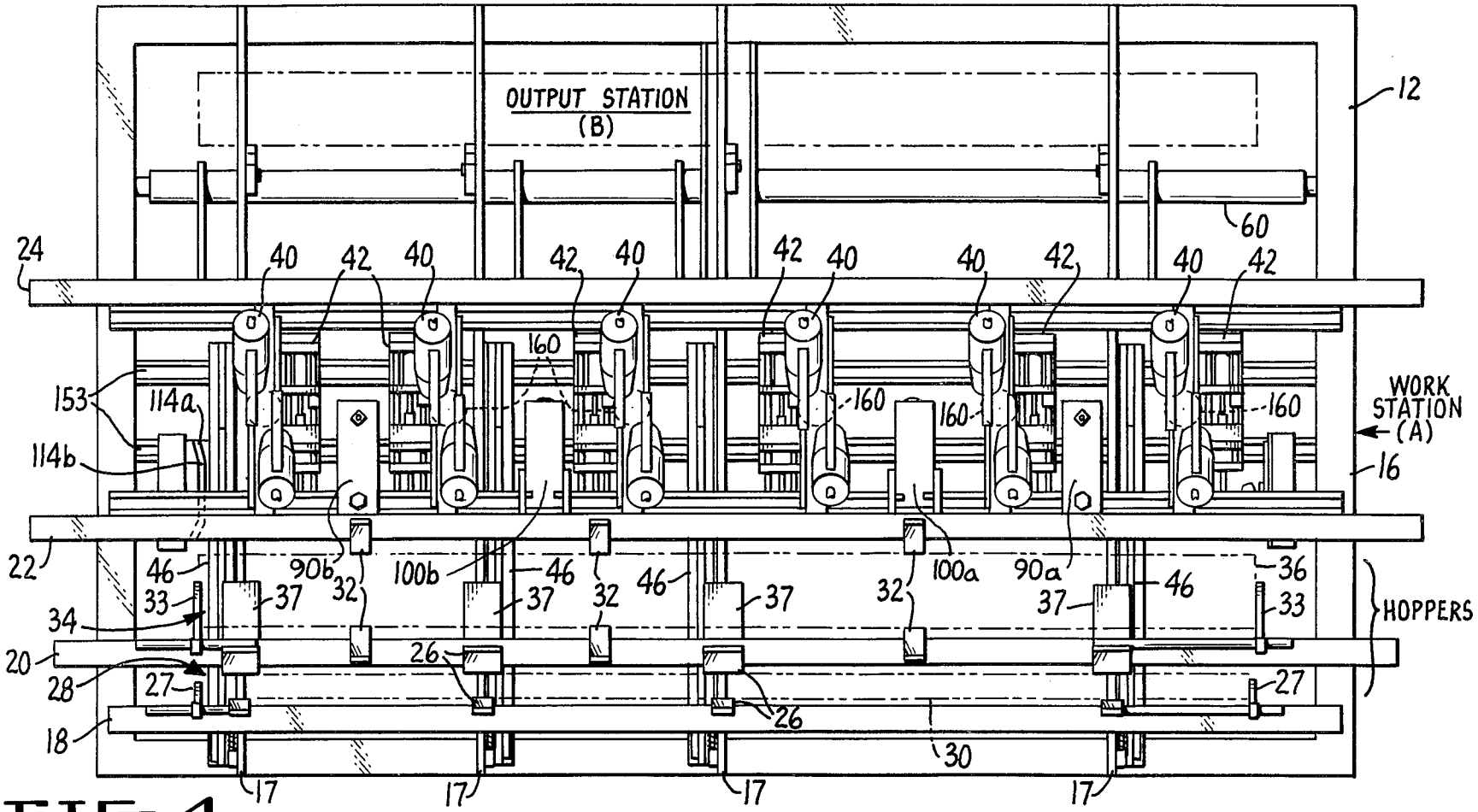
FIG. 4 is a top plan view of the apparatus of FIG. 1.

Referring to FIGS. 1 and 4, there is illustrated an automatic doorstop-jamb alignment and attachment apparatus, designated with reference numeral 10, shown as including a rectangularly shaped frame 12 with legs 14 mounted to the corners thereof for supporting the frame 12. The frame 12 is formed by two parallel pairs of side elements 16; and attached at spaced locations and extending from one frame side element 16 to the opposite frame side element 16 are four parallel cross members 17 which are used to mount and support certain of the elements of the apparatus 10. Attached to the other two opposed side elements 16 of the frame 12 are braces 18, 20, 22 and 24, which are also used to mount various other elements. As illustrated, the braces 18, 20, 22 and 24 are mounted, relative to the frame 12, so that they overlie the central area defined by the side elements 16 and 18.

Attached to the braces 18 and 20 in generally opposing relation is a number of spaced, upright guide bars 26 to form a hopper 28 for containing a vertical stack of doorstops 30. In similar fashion, a number of upright guide bars 32 is mounted to the braces 20 and 22 to form a hopper 34 containing a vertical stack of doorjambs 36. A number of the stops 30 are loaded in the hopper 28 to form a vertical stack such as that indicated in FIG. 2. Reference arms 27 are attached to an outboard pair of the upright guide members 26 to initially register the ends of the stop 30. Similarly, the jamb hopper 34 is also provided with reference arms 33 for the same purpose.

The jambs 36 are supported in the jamb hopper 34 by four horizontally extending shelf members 37 (FIGS. 4 and 6) which are mounted to the brace 20 at spaced locations therealong and extend laterally toward brace 22.

Figure 2:
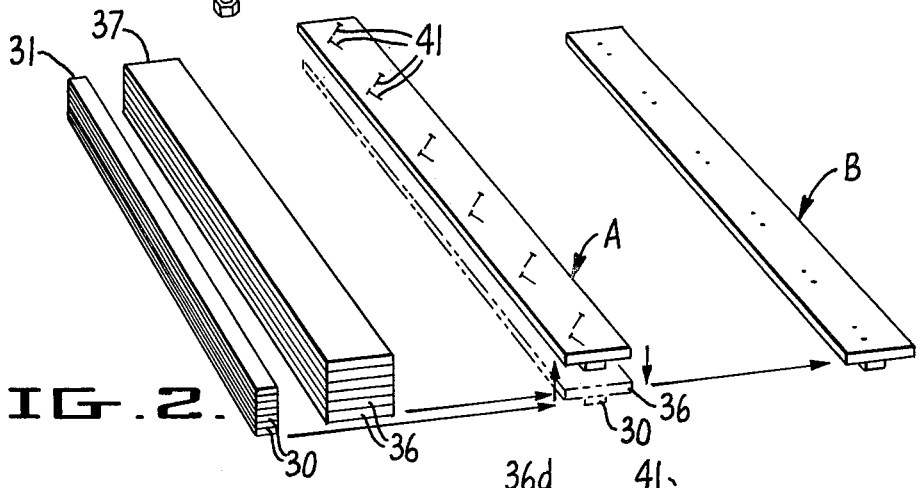
FIG. 2 is a diagrammatical illustration of the process performed by the apparatus of FIG. 1.
Figure 3:
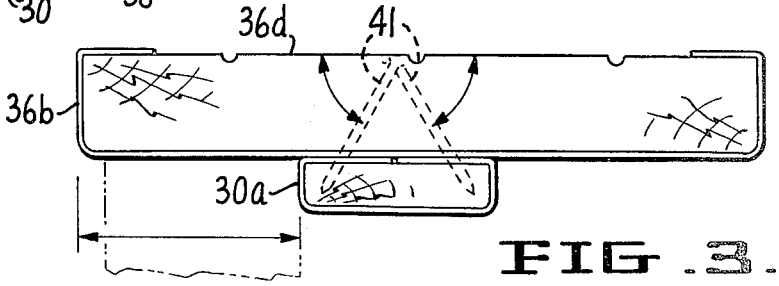
FIG. 3 is a cross-sectional view of a doorstop attached to a doorjamb, illustrating the preferred method of attachment.

Twelve individual air nailers 40 are mounted to and between the braces 22 and 24 and oriented to dispense nails generally angularly downward to define a nailing or work station A (FIGS. 2, 4 and 6) therebelow. The air nailers 40 are separated into two groups, each group being arranged to fire nails in a relative linear arrangement, the nails of one group generally converging toward, but linearly spaced from, those of the other group (FIGS. 2 and 3). Underlying the linear arrangement of air nailers 40 are six reference clamps 42.

Preferably, the nails fired by the air nailers 40 enter the rear surface 36*d* of the jamb 36 at an angle of 30° from vertical, forming the inverted V shown in FIG. 3. However, other relative positioning of the nails fired by air nailers 40 can be obtained due to the capability of adjusting the positions of the air nailers 40 relative to the stop and jamb to be nailed.

Figure 5:
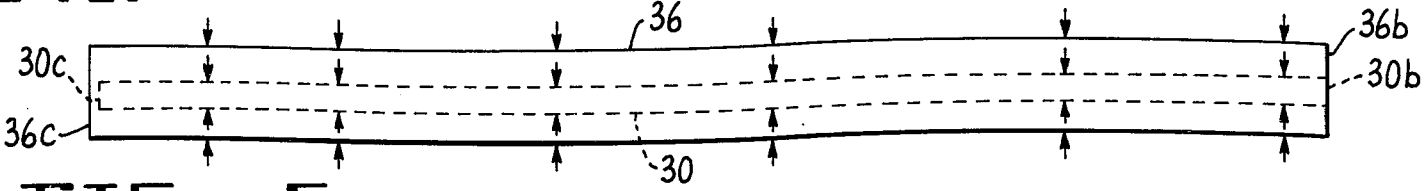
FIG. 5 is a top plan view of a doorstop-jamb combination illustrating indexing of the one relative to the other.

FIGS. 2, 3 and 5 graphically illustrate the essential operation of the present invention. The apparatus 10 will withdraw a single stop 30 and a single jamb 36 from the bottom of the vertical stacks of stops and jambs 31, 37 (FIG. 2) and transport them to the work station A, where they are received by the six reference clamps 42. The clamping action performed by the reference clamps 42 longitudinally aligns the withdrawn stop 30 and jamb 36 so that their respective leading edges 30*a* and 36*a* are positioned in parallel, spaced relation as indicated in FIGS. 3 and 5. Additionally, the ends 30*b*, 36*b* and 30*c*, 36*c* of the stop and jamb 30 and 36, respectively, are registered in a predetermined arrangement (illustrated in FIG. 5) by end-registering apparatus, which will be more fully described below.

Once proper registration of the stop 30 and jamb 36 are obtained at the work station, the two are placed in nailing relation with the air nailers 40 by the reference clamps and nails 41 fired into the back surface 36*d* of the jamb 36 to affix the underlying stop 30 thereto in the manner illustrated in FIG. 3. The combination is removed from the work station A simultaneously with the transporting of a newly withdrawn stop 30 and jamb 36 to the work station A for nailing.

FIGS. 6–12 illustrate the transport mechanism used to withdraw individual ones of the stops 30 and jambs 36 from the hoppers 28 and 34 and transport them to work station A. As illustrated, the transport mechanism includes four parallel, spaced-apart, elongate transport bars 46 (FIGS. 4 and 6–12) slidably mounted on a T-shaped track 48 for longitudinal movement along the track 48. Each T-shaped track, in turn, is mounted to one of the cross members 17; thus movement of the transport bars in a direction perpendicular to the orientation of the hoppers 28 and 34, carrying withdrawn stops 30 and jambs 36 in a direction transverse their lengths. Each transport bar 46 is connected to a throw arm 54 via a connecting link 52, which is pivotally attached to the transport bar 46 and throw arm 54 at 50 and 56, respectively. The end 58 of throw arm 54, opposite the pivotal attachment at 56, is fixedly attached to a cylindrical drive shaft 60 (FIGS. 1, 4). Drive shaft 60 is rotatably mounted to cross members 62, which extend between adjacent pairs of legs 14 via coupling 64 (FIG. 1).

Also fixedly attached to the drive shaft 60 is one end of a drive arm 66. A fluid-actuatable cylinder 68 is pivotally connected to its plunger to the drive arm 66 for moving the drive arm 66 between two positions, to wit: the feed return position (illustrated in FIG. 6 by the throw and drive arms 54 and 66 drawn in unbroken lines) and the feed extend position (throw and drive arms 54 and 66 drawn in phantom). Thus, the linear movement produced by the fluid-actuatable cylinder 68 is communicated (and amplified) to each transport bar 46 via a drive train that includes the drive arm 66, drive shaft 60, throw arm 54 and connecting link 52.

Figure 10:
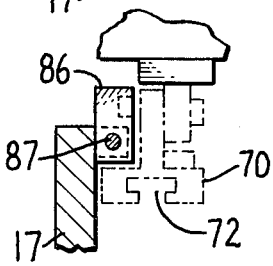
FIG. 10 is a cross-sectional view taken along line 10—10 of FIG. 9.
Figure 11:
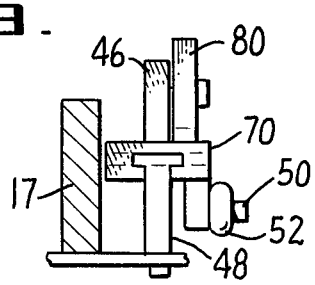
FIG. 11 is an end view of the transport mechanism, partly in section, taken along line 11—11 of FIG. 9.
Figure 12:
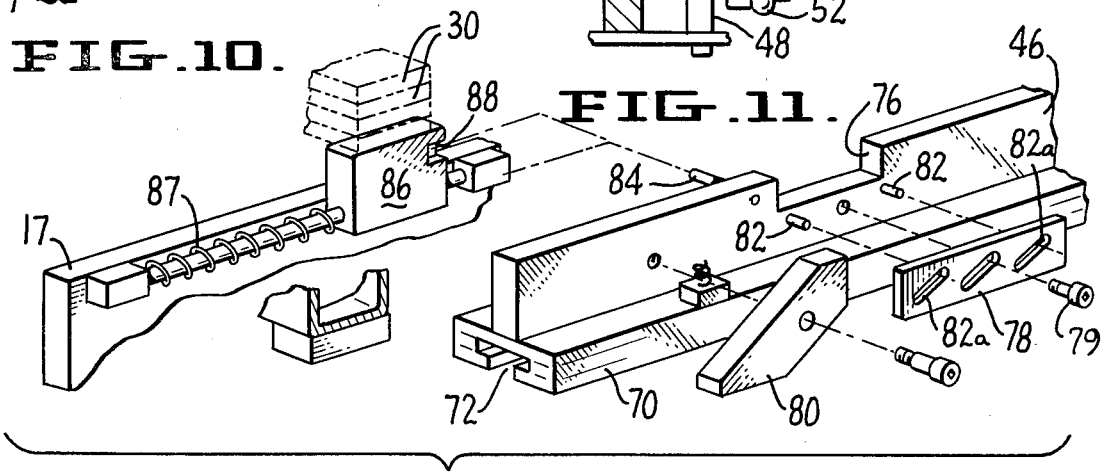
FIG. 12 is an exploded view of a portion of the doorstop-withdrawing mechanism of FIGS. 7–9.

Each transport bar 46 is provided with a base portion 70 which has formed therein a T-shaped, longitudinally extending channel 72, configured to receive and slidably move upon the T-shaped track 48 (FIGS. 10, 11 and 12). An upper edge of the transport bar 46 provided with a notch 76 that is adapted to receive a stop 30. The depth of the notch 76 is made adjustable by an adjustment plate 78 that is releasably attached to the transport bar 46, adjacent the notch 76, by a threaded bolt 79. A parallel relationship between the long edges of the adjustment plate 78 and the transport bar 46 are maintained via the guide members 82 which extend laterally outward from the transport bar 46 to pass through the guide apertures 82*a* formed in the adjustment plate 78 (FIG. 12).

Rotatably attached to the transport bar 46, proximate the notch 76, is a spring-loaded dog 80. As will be described more fully below, the notch 76 and spring-loaded dog 80 function to withdraw a stop 30 and jamb 36, respectively, form the vertical stack contained by the hoppers 28 and 34; and then to transport the withdrawn stop and jamb to work station A, positioning them in underlying relation with the air nailers 40.

Figure 8:
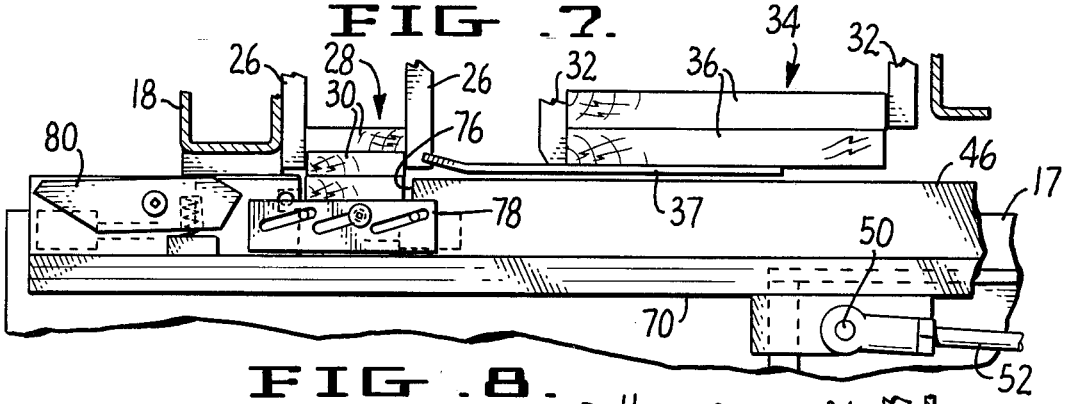
FIGS. 8 and 9 are side elevational views of the element shown in FIG. 7, with the transport mechanism in a different position in each figure.
Figure 9:
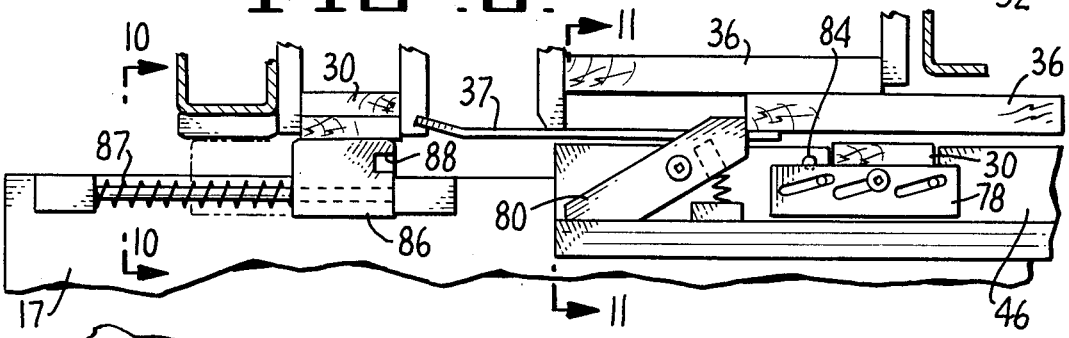

Mounted to each cross member 17 is a rod 87 which carries a slide block 86 (FIGS. 9, 10 and 12). A helical spring surrounds the rod 87 to bias the slide block 86 to a position beneath the vertical stack of stops held by the stop hopper 28. A finger element 84 that is mounted to the transport bar 46, proximate the notch 76 and on the side of the transport bar opposite that to which the spring-loaded dog 80 is attached (FIG. 12). As illustrated, the finger element 84 is placed so that it can engage a recess 88 formed in the slide block 86 and urge the spring-biased slide block 86 away from its position underlying the vertical stack of doorstops 30 when the transport bar 46 is placed in the feed return position (FIGS. 8 and 12). Removal of the slide block from its position underlying stops 30 allows a bottom stop to drop into the recess 76 (FIGS. 7 and 8), thereby effecting withdrawal of a stop from the hopper 28.

The end of the transport bar 46 opposite that having the notch 76 and spring-loaded dog 80 is provided with a recessed portion 85 (FIGS. 6 and 17) proximate which, and pivotally attached to the transport bar 46 at 81, is a second dog 83. As will be explained in greater detail below, the recess 85 and dog 83 cooperate to remove the finished work product (i.e., connect stop and jamb) of the apparatus 10 from the work station as the transport bar 46 withdraws another stop and jamb 30, 36 pair.

Figure 13:
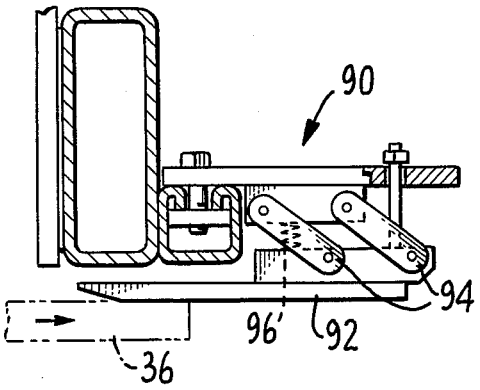
FIG. 13 is a part sectional, part elevational, view of the hold-down ski used to longitudinally straighten warped or bowed doorjambs.

Referring now to FIG. 13, there is shown one of two hold-down ski assemblies 90 which function to hold down and straighten longitudinally warped or bowed doorjambs 36 so that the spring-loaded feed dog 80 can engage the jamb 36. That is, the doorjamb 36 may be sufficiently bowed so that the spring-loaded dog 80 is unable to engage the jamb to urge it toward the work station A. The hold-down ski assembly remedies this problem. As illustrated, the hold-down assembly includes a hold-down plate 92 that is swivably mounted by chain link attachments 94 which act to keep the hold-down plate in a horizontal position. A spring 96 biases the hold-down plate 92 downward. The two hold-down assemblies 90 are positioned at 90*a* and 90*b* (FIG. 4).

Figure 14:
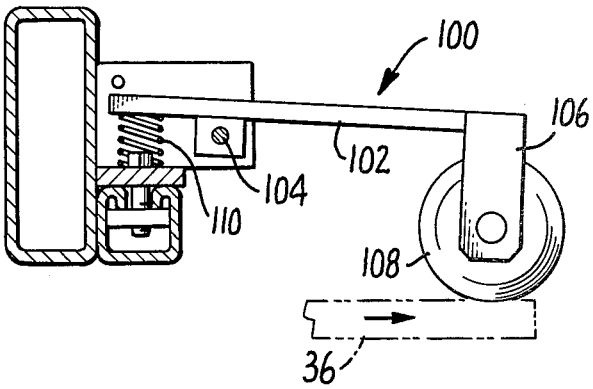
FIG. 14 is a part sectional, part elevational, view of the hold-down roller used to ensure that the transported doorstop and overlying doorjamb stop when the transport mechanism stops.

Referring to FIG. 14, there is shown a hold-down roller assembly 100, which is one of two mounted at 100*a* and 100*b* of FIG.4. The hold-down roller assembly 100 includes a hold-down arm 102 which is pivotally mounted at 104. A bracket 106, to which a roller 108 is journalled, is attached to one end of the hold-down arm 102. A spring 110 acts to bias the opposite end of the hold-down arm 102 upward, forcing the roller-mounted end of the hold-down arm 102 downward. The hold-down roller assembly functions to increase the frictional engagement between the jamb 36 and underlying transport bar 46 so that when the transport bar 46 stops in the feed extend position, the momentum of the transported stop and jamb is dissipated; that is, when the transport bar 46 stops at the work station A, the withdrawn stop and jamb carried by the transport bar 46 also stop.

Typically, when the doorjamb 36 is attached to its corresponding stop 30, it is desirable that the respective ends of the jamb 36 and stop 30 be registered relative to one another. For example, referring to FIG. 5, the respective ends 30*b* and 36*b* of stop 30 and jamb 36 may be vertically aligned before nailing. However, the stop 30 may be shorter than the jamb 36, as illustrated, so that the ends 30*c* and 36*c* of the stop 30 and jamb 36 effect a relief. To achieve this alignment, therefore, there is provided an end-registering mechanism illustrated in FIGS. 15 and 16 mounted to the frame 12 and situated proximate on the hopper side of the work station A. The registration assembly includes overlying end plates 114*a* and 114*b* having bevelled portions 116*a* and 116*b*. Located in opposed, confronting relation to the end plates 114*a*, 114*b* are spring-loaded registering arms 118*a* and 118*b* which are pivotally mounted to a bracket 120 at 122.

The end-registering mechanism is positioned so that the withdrawn stops 30 and jambs 36 being carried to the work station A by the transport bars 46, will engage the end plates 114*a*, 114*b* and the spring-biased registering arms 118*a* and 118*b*. The registering arms work to urge the jamb 36 and stop 30 toward the end plates 114*a* and 114*b*. The alignment faces 115 of the respective end plates 114*a*, 114*b* function to establish registration of the stop 30 to the overlying jamb 36. Thus, as the transported stops and jambs 30 and 36 pass through the registering assembly to the nailing station, accurate alignment of the ends is established.

However, there remains a more exact longitudinal alignment of the stop 30 and the jamb 36 to which it is to be attached to provide an appropriate relief between the leading edges of the two pieces. This is accomplished by the clamp assembly 42 illustrated in FIGS. 19–23. There are six such clamp assemblies 42 at the work station A, evenly spaced in a linear arrangement underlying air nailers 40 (FIGS. 1 and 4). Each of the clamp assemblies 42 is identical in construction and, therefore, a description of one will apply equally to all.

Figure 19:
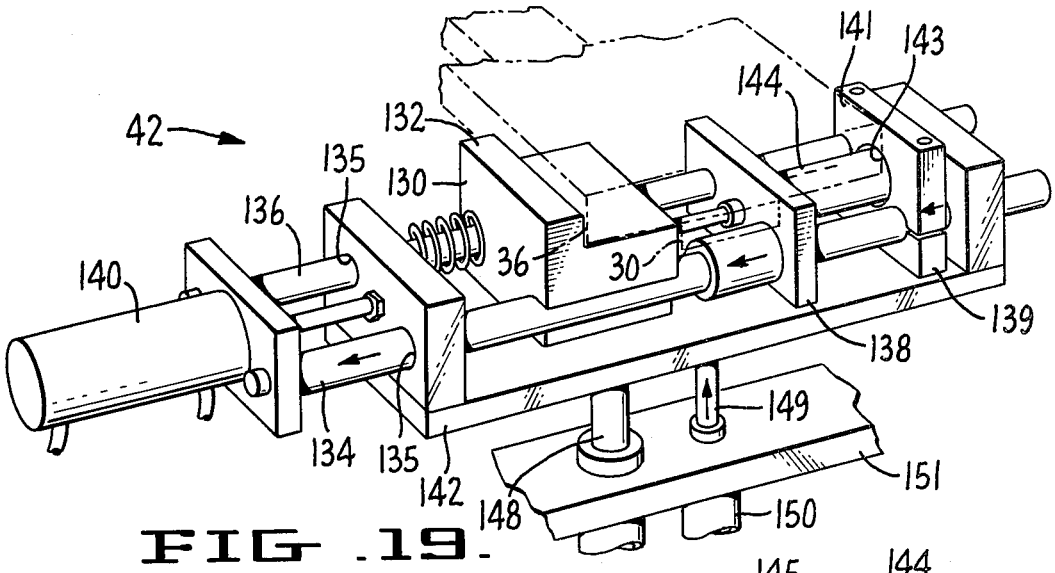
FIG. 19 is an elevational view of the reference assembly used in the apparatus of the present invention to align the leading edges of the withdrawn doorstop and doorjamb.
Figure 20:
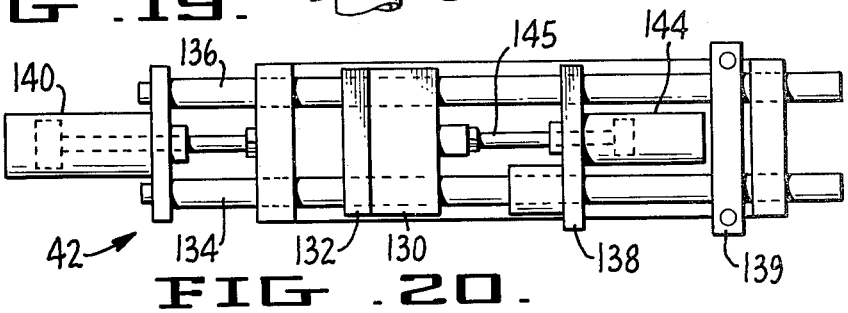
FIG. 20 is a top elevational view of the element shown in FIG. 19.

As illustrated in FIGS. 19–23, the clamp assembly 42 includes a reference block 130 that is provided with an upstanding shoulder 132. The reference block 139 is slidably mounted for free movement on parallel guide rods 134 and 136. Also mounted on the guide rods 134 and 136, and freely movable thereon, is a stop clamp plate 138 and a jamb clamp plate 139. A fluid-actuatable cylinder 140 is connected to one end of the guide rods 134 and 136, the plunger of the cylinder being attached to the reference assembly mount 142. A fluid-actuatable cylinder 144 is mounted to the stop clamp plate 138 with the plunger 145 of the cylinder 144 extending through the stop clamp plate 138 to attach to the reference block 130 (FIG. 20). An aperture 143 is formed in the jamb clamp plate to allow for the cylinder 144.

Figure 21:
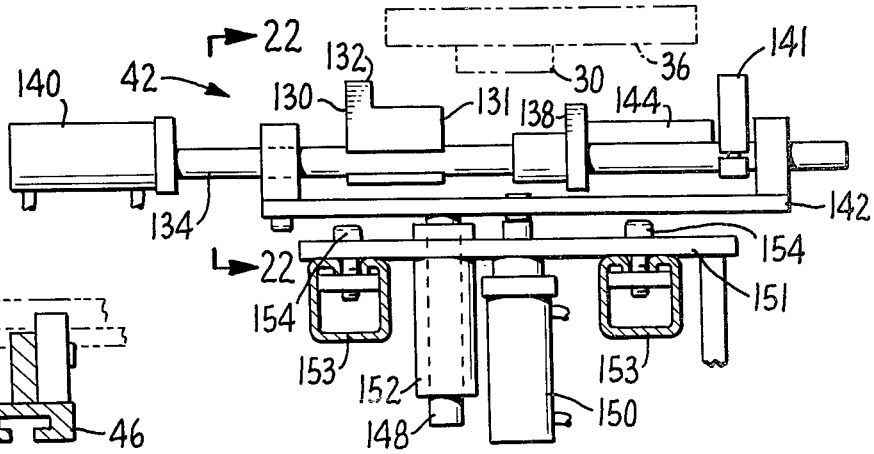
FIG. 21 is a side elevational view, partly in section, illustrating the reference assembly of FIG. 19.
Figure 22:
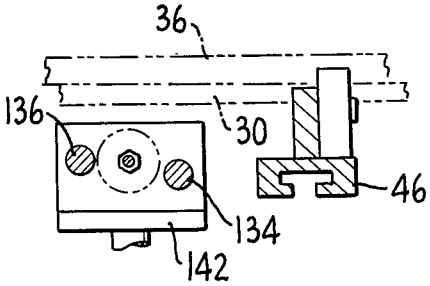
FIG. 22 is a cross-sectional view taken along line 22—22 of FIG. 21.
Figure 23:
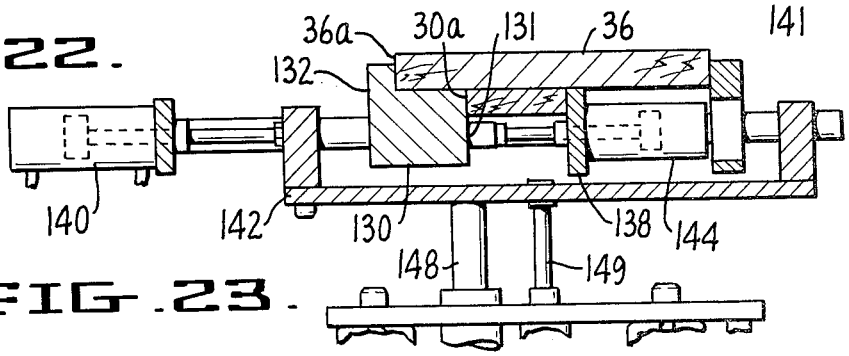
FIG. 23 is a part sectional, part elevational, view of the reference assembly of FIG. 19 illustrating the aligning and clamping action performed by the assembly.

Actuation of the fluid-actuatable cylinder 144 will cause the stop clamp plate 138 to be pulled toward or away from the reference block 130, effecting a clamping action that clamps a stop 30 in the recess formed between the face 131 of the reference block 130 and stop clamp plate 138 (FIGS. 21 and 23). In similar fashion, actuation of the fluid-actuatable cylinder 140 will move the guide rods 134 and 136, relative to the assembly mount 142, which in turn moves the stop clamp plate 138 attached to the guide rods. Thereby, the stop clamp plate 138 is moved toward or away from the reference block 130 to clamp therebetween a jamb 36 (FIG. 23). It should be noted that while the stop clamp plate 138 is fixedly attached to the guide rods 134, 136, the guide rods freely slide through the apertures 135 provided in the mount 142.

The reference assembly mount 142 is, in turn, situated atop a plunger 149 of a fluid-actuatable cylinder 150 and a guide post 148. The fluid-actuatable cylinder 150 is mounted to a bracket assembly 151 that includes a cylindrical guide 152 for receiving guide post 148. The bracket assembly is affixed to channel-shaped mounting guides 153 via conventional attachment means 154 such as, for example, a nut and bolt combination. In this way, the entire reference assembly 42 can be repositioned laterally when desired. Fluid-actuatable cylinder 150 functions to raise the reference assembly containing a clamped and aligned stop 30 and jamb 36 combination toward the air nailers 40, placing the jamb and stop in nailing relation thereto.

The longitudinal arrangement of the twelve air nailers 40 (FIGS. 1 and 4) overlying the six clamp assemblies 42 define the work station A where a withdrawn jamb 36 and stop 30 are attached to one another. The air nailers 40 are mounted to and between the mounting racks 22 and 24 via elongate support channels 155 (FIGS. 1, 3 and 17) which support the air nailer mounting apparatus generally designated with the reference numeral 156. The mounting apparatus 156 attaches to the support channels 155 via attachment means (e.g., via a nut and bolt combination) 157 which can be loosened to allow the corresponding air nailer to be repositioned along the length of the support channel 155.

There is presently commercially available on the market today a number of air nailers which can be adapted for use with the present invention—such as, for example, air nailers manufactured by Senco Corporation of Cincinnati, Ohio or those manufactured by Paslode Company of Skokie, Ill. It should be evident to those skilled in the art that depending upon the particular air nailer chosen, the air nailer mounting apparatus 152 will have to be constructed and configured accordingly. Preferably, the air nailers 40 are mounted so that their nail-dispensing barrels 41 fire the nails using a "toenail" technique whereby the nails are placed in the stop/jamb 30, 36 combination forming approximately a 30° angle from vertical, as illustrated in FIG. 3.

Figures 17, 18:
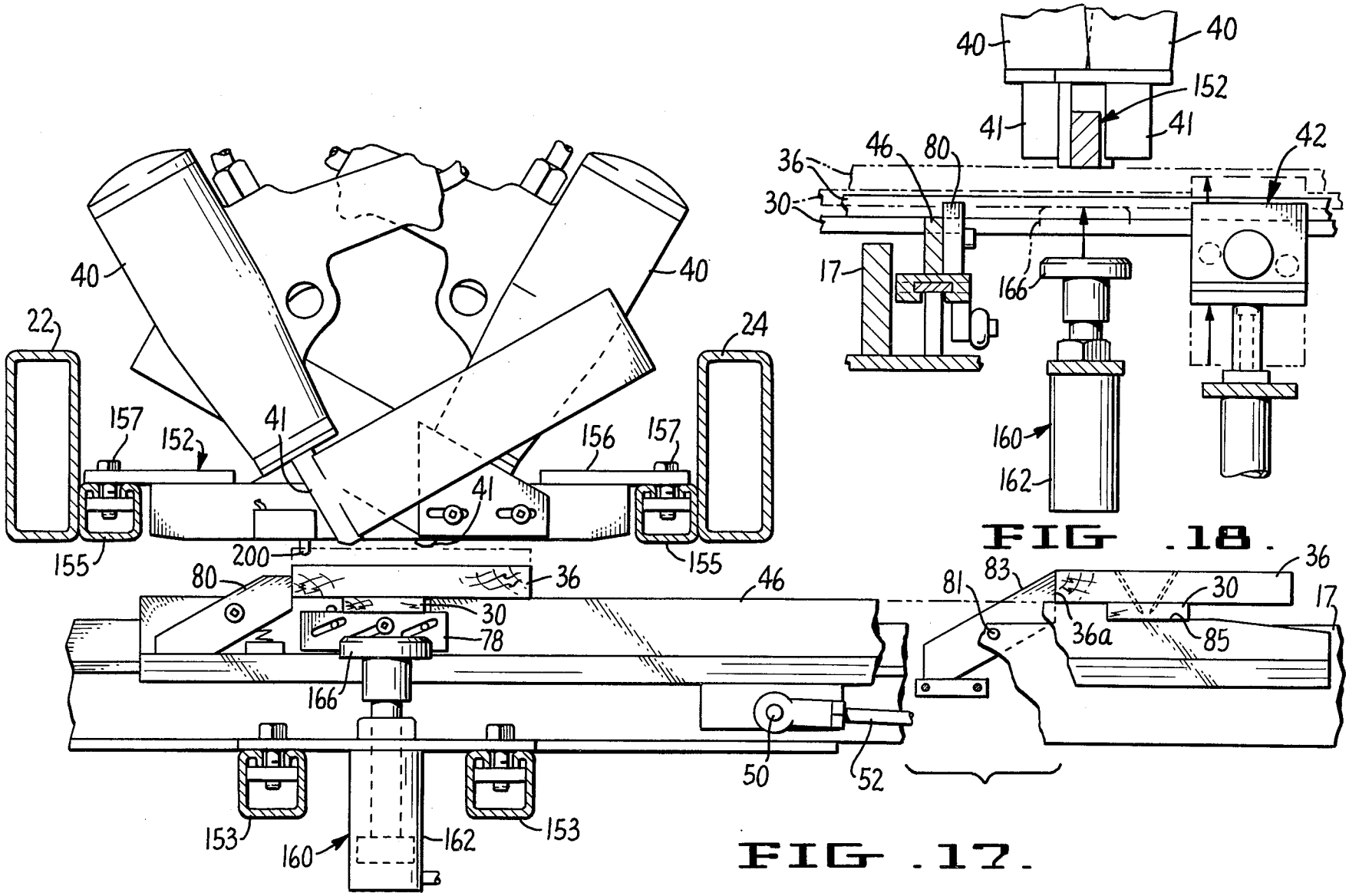
FIG. 17 is a part sectional, part elevational, view of the nailing station illustrating placement of the withdrawn doorstop and doorjamb relative to the air nailers.
FIG. 18 is an elevational view of one of the six support mechanisms used for underlying support for the stop/jamb combination during attachment.

Underlying support for the stop and jamb 30, 36 to be nailed, during the nailing operation, is provided in part by the clamp assemblies 42; that is, the six clamp assemblies 42 are positioned, relative to six of the air nailers 40, so that the clamp assemblies support the stop 30 and jamb 36 while a nail 41 is being fired. Support for the nailing action of the remaining six air nailers 40 is provided by six support mechanisms 160 (FIGS. 4, 6, 17 and 18). There is one support mechanism 160 situated adjacent each reference assembly 42, underlying an air nailer 40. Referring to FIGS. 17 and 18, the support mechanism 160 is shown as including a fluid-actuatable cylinder 162 and a support pad 166 attached to the plunger 164 thereof. Preferably, although not specifically illustrated, the support mechanism 160 is mounted in the same manner as the air nailers 40 and clamp apparatus 42; that is, so that they (the individual support mechanisms 160) are repositionable. When the fluid-actuatable cylinder 162 is actuated, the plunger 164 raises the support pad 166 into supporting engagement with the stop 30 and overlying jamb 36, thereby providing support during the nailing operation.

OPERATION

Figure 24:
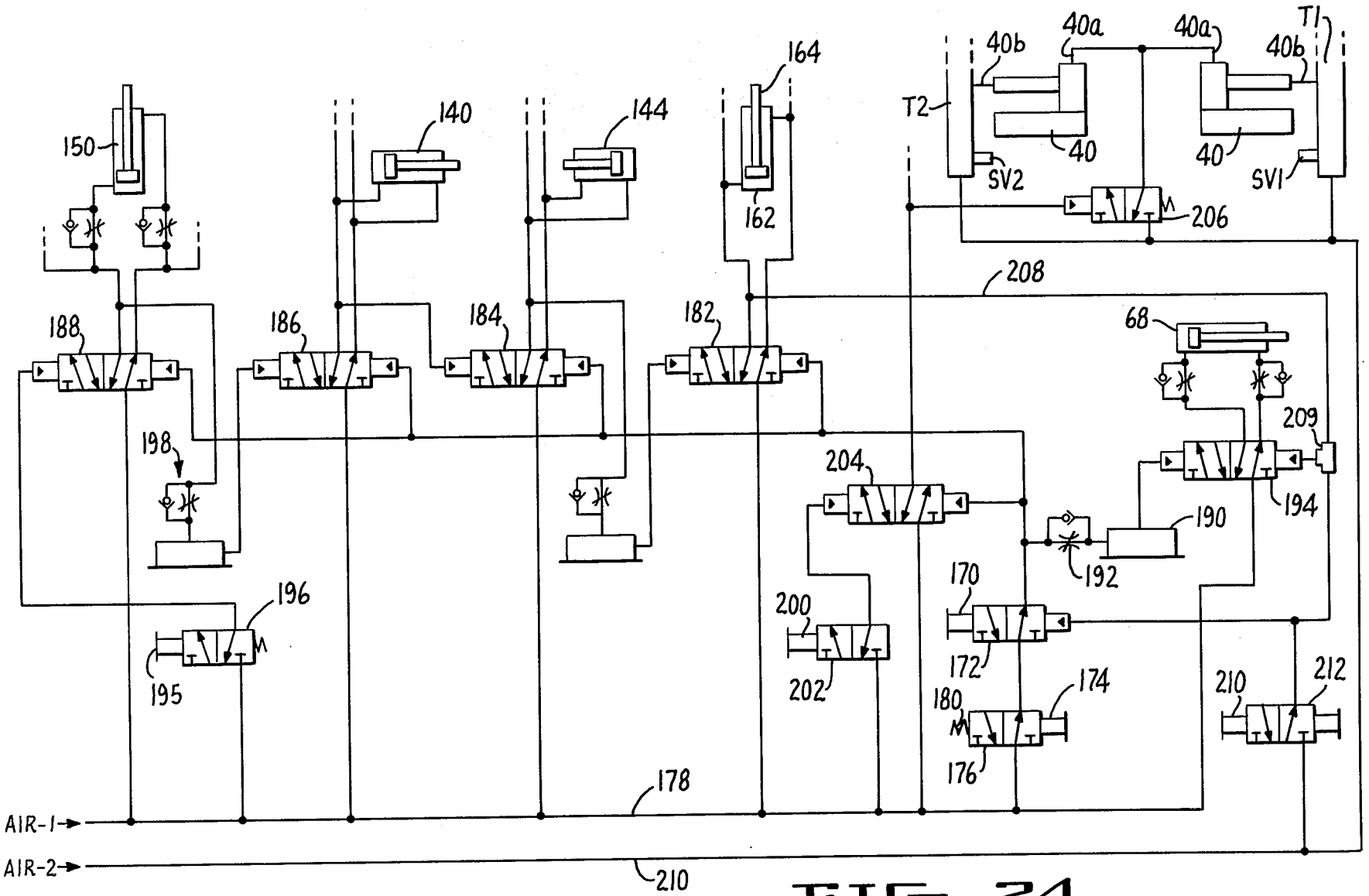
FIG. 24 is a schematic representation of the control system for the actuating elements of the system.

FIG. 24 illustrates the (fluid-controlled) logic system that controls operation of the various elements of the apparatus 10. Control is effected by applying a fluid supply (e.g., air) at predetermined times, and in a predetermined manner, to the fluid-actuatable cylinders used to provide the motive forces for the moving elements of the apparatus 10. As will be seen in the following discussion by those skilled in the art, the described embodiment makes use of commercially available air and mechanically actuated valves to communicate a fluid supply to the fluid-actuatable cylinders. Thus, double-piloted, four-way (fluid-actuated) valves (such as, for example, the fluid valve 182 of FIG. 24) are used in combination with mechanically actuated fluid valves (such as fluid valve 176), the latter for detecting predetermined positions of an object, to command actuation of the fluid-actuatable cylinders of the apparatus 10.

Typically, prior to commencing operation, the throw arm 54 of the transport mechanism is in the feed return position (FIG. 6) and the various fluid valves are in the status indicated in FIG. 24. The position of the throw arm 54 (when in the feed return position) is sensed by a mechanical plunger 174, placing the spring-loaded fluid valve 176 in condition to communicate fluid supply line 178 to the fluid valve 172. Thus, actuation of mechanical plunger 174 by an operator will initiate operation to communicate the air supply line 178 to the fluid valves 182, 184, 186 and 188, tripping the fluid valves 182, 184, 186 and 188 to a state opposite that illustrated in FIG. 24 and causing them, in turn, to also communicate the supply line 178 to fluid-actuatable cylinders 162, 144, 140 and 150, respectively. (It should be noted that although ony single fluid-actuatable cylinders 162, 144, 140 and 150 are shown in FIG. 24, there are, in fact, six such cylinders each—as previously noted above.) Application of the fluid supply line 178 to the fluid-actuatable cylinders 162, 144, 140 and 150 initiates the following actions—if they have not previously occurred: The six support pads 166 (FIG. 18) are lowered by fluid-actuatable cylinder 162; the stop clamp and jamb clamp plates 138 and 139, respectively (FIG. 19), are moved away from the reference block 130 by the fluid-actuatable cylinders 144 and 140; and the clamp assembly is lowered by the fluid-actuatable cylinder 150. This procedure readies work station A for the receipt of a withdrawn stop 30 and jamb 36.

While in the feed return position, the respective transport arms 46 are positioned so that the finger element 84 (FIG. 12) has moved the respective slide blocks 86 along the guide rod 87 and away from its supportive position beneath the vertical stack of stops 30. With the slide blocks so removed, the bottom stop of the stack is allowed to fall into the notch 76 of each transport bar 46 (FIG. 8).

Upon actuation of fluid valve 172 (in conjunction with fluid valve 176) the supply line 178 is caused to be applied to fluid chamber 190 via an adjustable flow control member 192; and, after a predetermined time delay determined by the flow through the flow control device 192 and capacity of the fluid chamber 190, the fluid supply 178 is communicated to a control terminal of fluid valve 194. Fluid valve 194 is thereby set in a condition to communicate the supply line 178 to the fluid-actuatable drive cylinder 68 which, in turn, is actuated to begin moving the transport bars 46 along their respective tracks 48 via the drive chain (i.e., comprising drive arm 66, drive shaft 60, throw arm 54 and connecting link 52—FIG. 6) connected to the plunger of the cylinder 68.

As the transport bars 46 commence their longitudinal travel toward the work station, the spring-loaded slide blocks 86 are biased back to a position underlying and supporting the vertical stack of stops 30 (FIGS. 9 and 12). At the same time, the spring-loaded dog 80 attached to each transport bar 46 is released from its horizontal position (FIG. 8) and biased to an angularly disposed position (FIG. 9). Relative positioning of the transport bars 46 and the shelf members 36 (FIG. 2) allow the projection of the dogs to pass adjacent, but out of contact with, the support shelves. Biasing the dogs 80 into this angular orientation, however, allows their projections (above the upper edges of transport bars 46) to engage a longitudinal edge of the bottom jamb 36 of the vertical stack of jambs contained by the jamb hopper 34. As the transport bars 46 continue their longitudinal movement from the feed return position and toward the feed extend position, the bottom doorjamb 36 is urged from the support shelves 37 and onto the transport bars 46. It should be noted, as FIG. 9 illustrates, that the relative locations of the dog 80 and recess 76 position the withdrawn stop 30 and jamb 36 in approximate, longitudinal, registered relation as they are communicated to the work station A by the transport bars 46.

The transport bars 46 then carry the withdrawn stop 30 and overlying jamb 36 to the work station A for attachment to one another via the end-registering station defined by the spaced end plates and registration arms 114*a*, 114*b* and 118*a*, 118*b* (FIGS. 15 and 16) to cause adjacent registration of the respective ends of the withdrawn stop and jamb, as described above, before placement at the work station A.

The transport bar 46 continues its travel until the withdrawn stop 30 and jamb 36 are brought to a position beneath the air nailers 40 (FIG. 17) and overlying the reference and support assemblies 42 and 160, respectively. At this time, the throw arm 54 is in the feed extend position, illustrated in FIG. 6, causing the actuation block 173 of the throw arm to actuate mechanical plunger 194 of the spring-loaded fluid valve 196. Fluid valve 196, when so actuated, connects air supply line 178 to a control input of fluid valve 188 to place it in the state shown in FIG. 24. This, in turn, causes the fluid supply line 178 to be communicated to and to actuate the (six) actuatable cylinders 150, causing their respective plungers 149 to extend and raise the six reference assemblies 42, lifting the stop 30 and overlying jamb 36 form the transport bars 46.

At the same time, the fluid supply line 178 is also applied to a delay mechanism 198 (a series connection of an unadjustable flow control device and fluid chamber similar to fluid chamber 190 and flow control device 192); and, after a predetermined time period established by the delay mechanism 198, the fluid supply line 178 is then used to actuate flow control valve 186. So actuated, flow control valve 186 provides the air supply line 178 to fluid-actuatable cylinders 140 and to a control input of fluid control valve 184 which, when so actuated, communicates fluid supply line 178 to (and thereby actuates) fluid-actuatable cylinders 144. Referring to FIGS. 19–23, actuation of each fluid-actuatable cylinder 140 causes the cylinder to be moved away from the reference assembly mount 142, pulling with it the guide rods 134 and 136. Since the jamb clamp plate 139 is connected to the guide rods 134, 136, it is moved toward the reference block 130 and pulled into clamping relation with the jamb 36 (FIGS. 19 and 23). At the same time, the fluid-actuatable cylinder 144 carried by the reference assembly 42 retracts its plunger 145, which is connected to the reference block 130 (FIG. 20) to move the stop clamp plate 138 toward the reference block 130 and into clamping relation with the withdrawn stop 30.

Note, as FIGS. 19 and 23 illustrate, the clamping of the stop 30 and jamb 36 by the reference assembly 42 longitudinally aligns the two pieces, relatively positioning and spacing their leading edges 30*a* and 36*a* (FIGS. 3, 5, 19 and 23) a predetermined amount. The spacing is set by the distance between the stop face 131 of the reference block 130 (FIG. 21) and the reference block shoulder 132. Thereby, the leading edges of the jamb and attached stop are provided with an accurately spaced, longitudinal relief. Further, by using six individual reference assemblies effects longitudinal alignment at six individual points along the stop/jamb length. The advantage to this aspect of the invention is to minimize the effects of possible longitudinal warpage of the pieces, except in the most severe cases. Misalignment of the two pieces could result in a relief that would inhibit the door with which the stop/jamb combination is used from closing properly.

Figure 6:
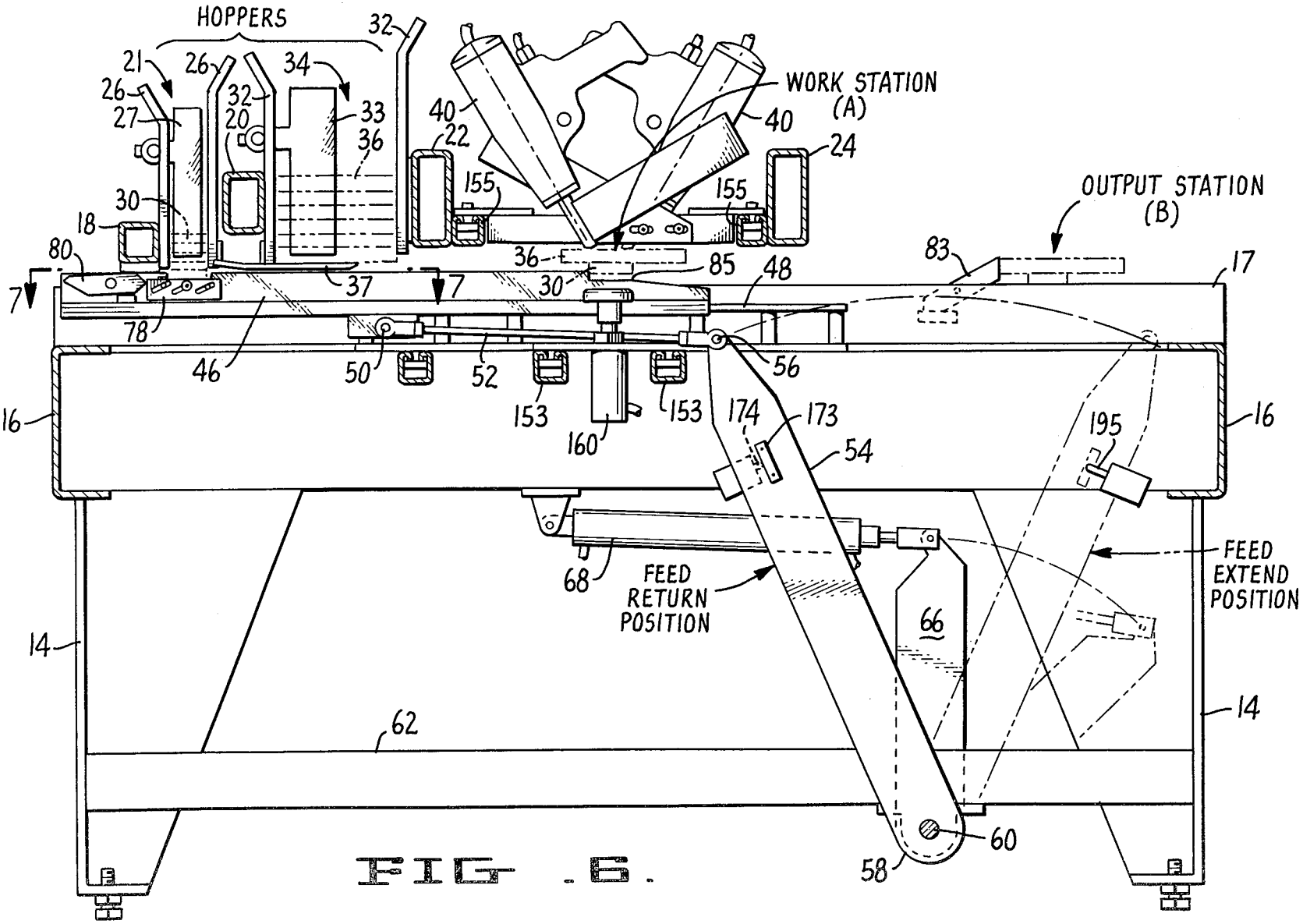
FIG. 6 is a cross-sectional view of the apparatus shown in FIGS. 1 and 4.
Figure 7:
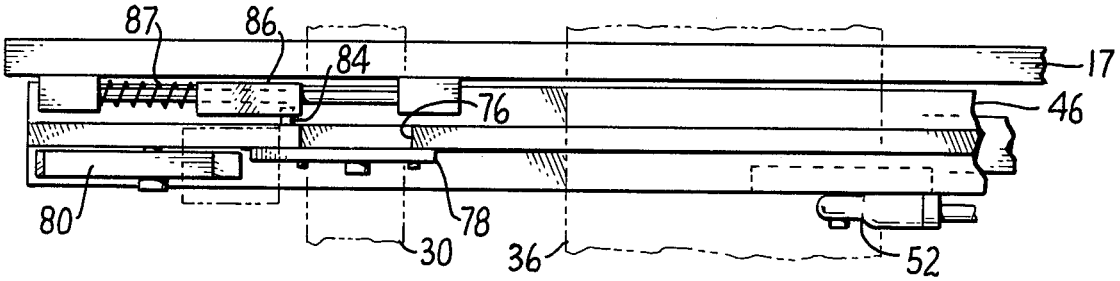
FIG. 7 is a sectional view as seen from line 7—7 of FIG. 6.
Figure 15:
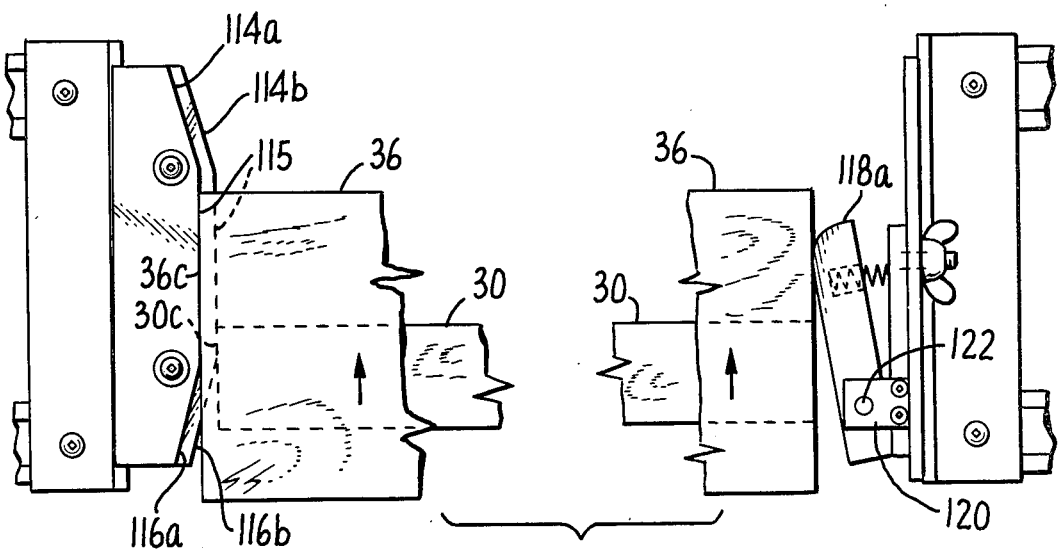
FIG. 15 is a part sectional, part top elevational, view of the indexing unit used to position the ends of the stop and jamb relative to each other.
Figure 16:
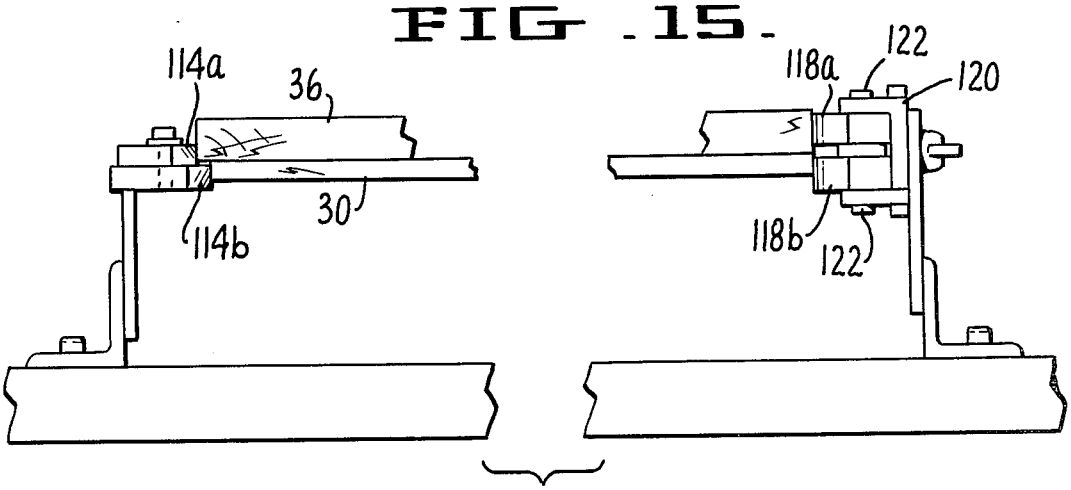
FIG. 16 is a side elevational view, partly in section, of the indexer of FIG. 15.

To summarize thus far, a stop 30 and jamb 36 have been withdrawn from the hoppers 28 and 34 (FIGS. 1, 4 and 6). The method of withdrawal places the jamb 36 in overlying relation to the stop to which it is to be attached. A withdrawn jamb 36 and stop 30 are transported to a position underlying air nailers 40 via an end alignment system which aligns the terminal end portions of the stop and jamb relative to one another (FIGS. 5, 15 and 16). The movement of transport bars 46 then ceases to position the withdrawn stop 30 and overlying jamb 36 beneath air nailers 40 and above six spaced-apart, linearly aligned reference assemblies 42. The reference assemblies then raise to accept the stop and overlying jamb 30, 36, clamping and longitudinally aligning the two pieces (FIGS. 19–23), and bringing the stop and jamb 30, 36 into nailing relation with the nail-dispensing barrels 41 of the air nailers 40 (FIG. 6).

In addition, the six support pads 166 are caused to be raised to a supporting position underneath the stop and jamb when the fluid supply line 178 is also applied to fluid valve 182 via a delay mechanism 199 (a combination adjustable air flow control and fluid chamber such as 192, 190, respectively); thereby, fluid valve 182 communicates the air supply line 178 to and actuates the fluid-actuatable cylinders 162.

The raising and clamping of the work material, as well as the positioning of the support pad 166, is relatively simultaneous. When the work material is raised into nailing position FIG. 17) with the overlying air nailers 40, it is brought into contact with a material sensor plunger 200 (FIGS. 17 and 24) which actuates the spring-loaded fluid valve 202. Fluid valve 202 then communicates the fluid supply line 178 to a control input of fluid valve 204 which, in turn, causes fluid valve 204 to communicate the fluid supply line 178 to the spring-loaded fluid valve 206.

Fluid valve 206 is typically spring-loaded to a state that communicates the fluid supply line 210 to the exhaust posts 40*a* of the air nailers 40. The fluid supply line 210 is also communicated to surge tanks $T_1$ and $T_2$ which feed the input ports 406 of the air nailers 40. Thus, the fluid pressure across the air nailers 40 is equalized, holding them ready for firing. When the fluid valve 206 is actuated, it is placed in a state to terminate communicating the fluid supply line 210 to the exhaust 40*a* of each of the air nailers 40. Rather, the fluid valve 206 provides an exhaust path (to the atmosphere) for the air nailers, causing them to fire nails into and through the jamb 36 and into the stop 30.

The surge tanks $T_1$ and $T_2$ provide a storage for a sufficient quantity of air for firing all twelve nailers at one time from a single air supply line. During the time a newly-withdrawn stop and jamb 30, 36 combination is being transported to the work station A, the pressure within the surge tanks $T_1$ and $T_2$ builds to the appropriate level needed for the next firing. In order to prevent possible overpressurizing the surge tanks, safety valves SV1 and SV2 are provided to limit the fluid pressure contained in the surge tanks to a predetermined level.

While the lifting, clamping, registering and nailing operation was taking place, the transport bars 46 of the feed mechanism was returning to its feed return position (FIG. 6). The return movement was initiated when communication of the fluid supply line 178 to the fluid-actuatable cylinder 62 was reversed. Such reversal was accomplished when the fluid supply line 178 was applied to an opposite control terminal of fluid valve 194 via fluid valve 182, fluid line 208 and shuttle valve 209. The plunger of the fluid-actuatable drive cylinder 68 retracts to move the drive arm from the feed extend position (FIG. 6) to the feed return position, returning the transport bars to a position for withdrawing another stop/jamb combination from the hoppers 28 and 34.

When the throw arm 54 reverts to the feed return position, the trip-block 175 located thereon actuates the mechanical plunger 174 of the spring-loaded fluid valve 176 (FIGS. 6 and 24). Thereby, the fluid supply line 178 is communicated to, and actuates, the fluid valve 182, 184, 186 and 188 (via the mechanically actuated fluid valve 172 which remains in a communicating position after the operator has actuated the mechanical plunger 170) to cause the fluid-actuatable cylinders 140, 144, 146 and 162 to lower the support assemblies 42 and support pad 166 and release the now-nailed stop and jamb 30 and 36.

In addition, and after the delay determined by the combination of the adjustable flow control device 192 and fluid chamber 190 (FIG. 24), communication of the fluid supply line 178 to the fluid-actuatable cylinder 68 is reversed via the fluid valve 194. Once again, extension of the plunger of the fluid-actuatable cylinder 68 commences to move the throw arm 54 from the feed return position toward and to the feed extend position (FIG. 6). Thus, withdrawal and transport of a stop 30 and jamb 36 from the hoppers 28 and 34 are again undertaken. At the same time, the now-combined jamb 36, stop 30, has been lowered onto the transport bar 46*a* where the stop 30 is received by the step 82. The upper portion of the dog 81 engages the leading edge 36*a* of the jamb 36 (FIGS. 6 and 17). Thus, as the transport bar 46 once again commences its longitudinal movement in the direction of work station A, bringing with it the newly withdrawn jamb 36 and underlying stop 30, the previously nailed jamb and stop is urged away from the air nailers 40 and to the output station (FIGS. 1, 4, 6 and 17).

The operation described above reciprocally continues until the operator again actuates the mechanical plunger 170 of the fluid valve 172 and interrupts fluid communication of the fluid supply line 178 to other parts of the system. As can be seen by inspection of FIG. 24, the apparatus 10 will not stop immediately (unless exactly positioned in the feed return position). Rather, it will continue to complete the remaining portion of the cycle.

Should it be necessary to immdiately stop operation in mid-cycle, the operator actuates the emergency shut-off valve 212 via the mechanical actuator 210. Thereby, the fluid valve 212 is caused to communicate the fluid supply line 210 to fluid valve 172, placing it in an off state, and to a control input of, and to actuate, fluid valve 194 via the shuttle valve 210. Fluid valve 194 is caused to communicate the fluid supply line 178 to the fluid-actuatable cylinder 68 to retract the cylinder's plunger. In turn, the transport mechanism is returned to the feed return position. All other fluid-actuatable cylinders are left in the position they were in when the emergency shut-off valve 212 is actuated.

In conclusion, therefore, there has been disclosed an automatic stop-jamb nailing apparatus that sequentially withdraws one doorstop and one doorjamb from hoppers containing vertical stacks of stops and jambs, transporting the stop and overlying jamb to a nailing station via an end-registering system that relatively registers the terminal ends of the transported stop and jamb; that clamps, relatively registers leading edges of, and lifts the stop and jamb into nailing relation with a plurality of linearly aligned air nailers for a nailing operation; and then transporting the finished product to an output station while a new withdrawn stop and jamb are being processed.

What is claimed is:

1. Apparatus for automatically registering and attaching a doorstop of a first length to a doorjamb of a second length, comprising:

a frame having means thereon for defining an elongate work station including a plurality of nail-dispensing means connected to said frame proximate said work station, said nail-dispensing means being relatively located in linear, spaced-apart fashion along said work station;

a first hopper mounted to said frame for containing a stack of doorjambs;

a second hopper mounted to said frame proximate said first hopper for containing a stack of doorstops;

transport means mounted on said frame for reciprocal movement between a first position proximate said first hopper, a second position proximate said second hopper, and a third position proximate said work station, said transport means including means for withdrawing one of said doorjambs and one of said doorstops from said first and second hoppers, respectively, when said transport means is positioned in said first and second positions, respectively, and for transporting said withdrawn doorstop and doorjamb to said work station when said transport means moves to said third position;

said transport means including a plurality of parallel, spaced, elongate arm members situated in generally underlying, transverse relation to said first and second hoppers and mounted for longitudinal movement between said first, second and third positions, each of said arm elements including an edge adapted to be moved into adjacent, confronting relation with said first and second hoppers when said bar elements are moved to said first and second positions, respectively, said edge having formed therein a stop-receiving slot, each of the slots being aligned relative to the other of said slots for receiving a doorstop; and means mounted to said frame proximate said work station for aligning and clamping said withdrawn doorstop and doorjamb in relative longitudinal relation and for holding said withdrawn doorstop and doorjamb during attachment thereof.

2. The apparatus of claim 1, wherein said clamping means includes a plurality of first clamp elements for releasably clamping and holding said withdrawn doorjamb and a plurality of second clamp elements for releasably clamping and holding said withdrawn doorstop, said first and second clamp elements being relatively positioned to clamp and hold said withdrawn doorjamb and doorstop in parallel, registered relation.

3. The apparatus of claim 1, wherein said arm elements includes means mounted thereon for withdrawing one of said doorjambs from said first hopper as said slots pass said first position, said doorjamb withdrawing means being mounted relative to said aligned slots to position said withdrawn doorjamb in generally overlying, registered relation to said aligned stops.

4. The apparatus of claim 1, including means mounted to said frame for relatively registering the respective ends of said withdrawn doorjamb and doorstop.

5. Apparatus for relatively registering and attaching a first elongate work piece to a second elongate work piece, the apparatus comprising:

a frame;

first hoppers and second hoppers mounted to said frame for containing said first and second work pieces, respectively, in vertical stacks;

clamp means mounted to said frame for longitudinally aligning and holding in juxtaposed relation said first work piece to said second work piece;

attachment means mounted to said frame and proximate said clamp means for attaching said first work piece to said second work piece;

at least a pair of elongate, spaced, parallel members mounted to said frame for longitudinal movement between a first position generally proximate and underlying said vertical stacks of first and second work pieces to a second position proximate said clamp means, each of said elongate members having means thereon for withdrawing a bottom one of said first and second work pieces from said respective vertical stacks and for transporting said withdrawn ones of first and second work pieces to said clamp means;

means for reciprocally moving said elongate members between said first and second positions; and means for moving said clamp means into clamping relation with said withdrawn ones of first and second work pieces when said elongate members are in said second position and for subsequently positioning said withdrawn first and second work pieces in attaching relation with said attachment means.

6. The apparatus of claim 5, wherein said attachment apparatus includes a plurality of air-actuated nail guns oriented in relative linear, spaced relation.

7. The apparatus of claim 5, wherein said attachment apparatus includes a plurality of first and second spaced, air-actuated nail guns, each said nail gun having a barrel element for directing and dispensing an attachment nail, said plurality of nail guns being mounted to said frame and oriented to relatively position the barrel elements of the first nail guns in converging relation to the barrel elements of the second nail guns.

8. The apparatus of claim 5, including means mounted to said frame for relatively registering the ends of said first and second work pieces.

9. The apparatus of claim 8, wherein said registering means includes a plate element, means spaced from said plate for urging said first and second work pieces toward and against said plate element.

10. The apparatus of claim 9, wherein said registering means is mounted to said frame proximate said elongate members.

11. The apparatus of claim 5, wherein each of said elongate members includes a longitudinal edge having formed therein a recess, said recesses being relatively located to be placed in confronting relation with said first hopper for receiving said bottom one of said work pieces when said elongate members are in said first position.

12. The apparatus of claim 11, including at least a pair of block elements mounted to said frame for movement between a support position proximate said first hopper and underlying and supporting said vertical stack of first work pieces contained in said first hopper and a removed position away from said first hopper; and means mounted to said elongate members for moving said block elements from said support position to said removed position when said elongate elements are in said first position.

13. The apparatus of claim 5, wherein said withdrawing means includes an arm member pivotally mounted to each of said elongate members, and biasing means coupled to said arm members for biasing said arm members into position for engaging and urging said bottom one of said second work pieces out of and away from said second hopper and toward said clamping means as said elongate members move from said first position to said second position.

14. The apparatus of claim 12, including means coupled to each one of said block elements for biasing said block elements into said support position.

* * * * *